United States Patent [19]

Caruthers

[11] Patent Number: 4,813,669

[45] Date of Patent: Mar. 21, 1989

[54] EXERCISE DEVICES

[75] Inventor: Scott Caruthers, Glen Burnie, Md.

[73] Assignee: DAR Products Corporation, Baltimore, Md.

[21] Appl. No.: 94,794

[22] Filed: Sep. 14, 1987

[51] Int. Cl.[4] ..... A63B 11/00

[52] U.S. Cl. ..... 272/122; 272/119

[58] Field of Search ..... 272/122, 123, 117, 119; D21/197, 198

[56] References Cited

U.S. PATENT DOCUMENTS

| | | | |
|---|---|---|---|
| D. 26,418 | 12/1896 | Heydrick | 272/124 |
| 113,966 | 4/1871 | Ballou | 272/122 |
| D. 197,726 | 3/1964 | James, Jr. | 272/123 |
| D. 197,899 | 4/1964 | Sutcliffe | D21/197 |
| D. 203,052 | 11/1965 | Erhard | D21/197 |
| D. 203,837 | 2/1966 | James, Jr. | 272/123 |
| D. 215,057 | 8/1969 | Sun | 272/122 |
| D. 216,517 | 1/1970 | Dorn | D21/197 |
| D. 221,874 | 9/1971 | Collins, Jr. et al. | D21/197 |
| D. 223,843 | 6/1972 | Li | D21/197 |
| D. 242,865 | 12/1976 | Stamm | D21/197 |
| D. 244,628 | 6/1977 | Wright | D21/197 |
| D. 244,629 | 6/1977 | Wright | D21/197 |
| 259,752 | 6/1882 | Fisher | 272/122 |
| D. 264,625 | 5/1982 | Shiu | D21/197 |
| D. 267,737 | 1/1983 | Wright | D21/197 |
| D. 268,437 | 3/1983 | Giordano | D21/197 |
| D. 271,408 | 11/1983 | Bauer | D21/197 |
| D. 273,030 | 3/1984 | Anderson | 272/122 |
| D. 274,283 | 6/1984 | Wright | 272/122 |
| 654,097 | 7/1900 | Sandow | 272/122 |
| 714,463 | 11/1902 | Duffner | 128/25 R |
| 1,229,658 | 6/1917 | Sandow | 272/122 |
| 1,316,683 | 9/1919 | Calvert | 272/122 |
| 1,749,632 | 3/1930 | Ferris | 272/122 |
| 1,918,142 | 7/1933 | Smith | 272/122 |
| 3,231,270 | 1/1966 | Winer | 272/123 |
| 3,747,593 | 7/1973 | Taylor | 128/26 |
| 4,029,312 | 6/1977 | Wright | 272/134 |
| 4,361,324 | 11/1982 | Baroi | 272/123 |
| 4,627,618 | 12/1986 | Schwartz | 272/119 |
| 4,695,051 | 9/1987 | Jenison | 272/122 |

OTHER PUBLICATIONS

Promotional Literature on "Space Weights", by Grafar. American Druggist Magazine; Dec., 1982; p. 96.

*Primary Examiner*—Richard J. Apley
*Assistant Examiner*—J. Welsh
*Attorney, Agent, or Firm*—Leonard Bloom

[57] ABSTRACT

An exercise device for strengthening a user's targeted muscle, such as a bicep or the like, and a method for the assembly of the exercise device. The device includes a spherical housing having a weighted casing disposed. The housing has a cut-away portion and further has an opening formed therein which are in communication with each other. When the hand of the user is disposed in the opening, a forceful grip is not required during use of the exercise device. Thus the conjunctive use of adjoining muscles is substantially obviated, and the development of the targeted muscle is substantially improved.

20 Claims, 12 Drawing Sheets

EXERCISE DEVICES

FIELD OF THE INVENTION

The present invention relates to exercise devices, and more particularly, to exercise devices intended for the accelerated development and strengthening of a user's targeted muscle or muscles, as well as a method for the assembly and production of the exercise devices.

BACKGROUND OF THE INVENTION

The use of specialized equipment and various mechanical apparatuses for strengthening muscles is well known. Moreover, the desirability of providing a device which is capable of isolating and developing a specifically targeted muscle, one of the most common of which is the bicep, has also been long recognized.

However, one of the most troublesome problems presented with providing a device that can isolate and fully develop a muscle, such as the bicep, is that any sort of gripping and grasping action with the hand automatically employs the conjunctive muscles of the arm, including the forearm, tricep and deltoid. The same problem is encountered for the exercise and strengthening of other muscles in the body.

Unfortunately, each of the apparatuses and devices resorted to in the prior art for developing a specifically targeted muscle, such as the bicep, provide for some sort of handle which must be gripped and/or grasped by the user thereof. Examples of these devices are enumerated as follows:

| Inventor(s) | U.S. Pat. No. | Year Issued |
|---|---|---|
| Heydrick | D 26,418 | 1896 |
| Sandow | 654,097 | 1900 |
| Duffner | 714,463 | 1902 |
| Sandow | 1,229,658 | 1917 |
| Ferris | 1,749,632 | 1930 |
| Smith | 1,918,142 | 1933 |
| Winer | 3,231,270 | 1966 |
| Sun | D 215,057 | 1969 |
| Collins, Jr. et al | D 221,874 | 1971 |
| Li | D 223,843 | 1972 |
| Stamm | D 242,865 | 1976 |
| Wright | D 244,628 | 1977 |
| Wright | D 244,629 | 1977 |
| Shin | D 264,625 | 1982 |
| Baroi | 4,361,324 | 1982 |
| Wright | D 267,737 | 1983 |
| Giordano | D 268,437 | 1983 |
| Anderson | D 273,030 | 1984 |
| Wright | D 274,283 | 1984. |

This gripping and/or grasping action required by each of these devices is a definite disadvantage, since it involves the use of conjunctive muscles which prevents isolation required for the total development of the targeted muscle.

More specifically, every piece of exercise equipment or mechanical apparatus heretofore resorted to in the prior art invariably contains one common detractive denominator inherent within its design. Whatever else is intended—whether barbell, dumbbell, or one of the various exercise machines designed for total fitness—there exists some sort of handle which must be grasped in order to use the device. Quite clearly, one must hold onto a handle to make the device work. This action of holding the handle automatically and necessarily employs the conjunctive (adjoining) muscles. Such "helper" muscles actually take away from the isolation required for full development of any specifically targeted muscle.

This detractive denominator occurs because of the physiological structure of the human body. A precise interface of cardiovascular, neural-nervous system, respiratory, and muscular function is adequate to carry the average person through their normal daily activity. However, this interface is simply not sufficient to create an above average (or dynamic) physique. Combined with the time constraints that typically discourage regular exercise, the obvious result is a rather large population group composed of "ordinary" (somewhat less than splendidly developed) individuals.

Accordingly, it will be appreciated that there remains a need for an exercise device for strengthening a user's targeted muscle; wherein the device is capable of being utilized by the user, such that a forceful grip is not required by the user; and wherein the necessity for employing the user's conjunctive adjoining muscles is substantially reduced, thereby substantially reducing the tendency to detract from the development of the user's targeted muscle.

SUMMARY OF THE INVENTION

Accordingly, it is an object of the present invention to provide an exercise device for strengthening a user's targeted muscle which is capable of being utilized by the user thereof, such that the necessity for employing the user's conjunctive adjoining muscles is substantially reduced, thereby substantially reducing the tendency to detract from the development of the user's targeted muscle.

While not limited thereto, it is another object of the present invention to provide such an exercise device for strengthening a user's targeted muscles, including the abdominal region and extending thereabove, such as the biceps, triceps, forearm, deltoids and the pectoral muscles.

It is yet another object of the present invention to isolate the development of a targeted muscle by substantially eliminating the normal requirement for using the adjoining conjunctive muscles, thereby substantially improving the development of the targeted muscle.

The devices of the present invention, by virtue of their unique configuration, virtually eliminate the assistance of conjunctive muscles during the performance of many regimen exercises. Consequently, the effect translates as an achievement ratio of approximately 3.5 to 1. This is accomplished in a manner unparalleled in the physical fitness field.

More specifically, the user is not required to grasp the device of the present invention. Rather, the device simply cradles the user's hand, and the device is so designed that the user's hand remains at all times in a comfortable and natural "at rest" position. The device of the present invention cannot be grasped by a handle, because there is no handle to grasp. As a result, there is an accelerated rate of achievement, and less time is spent on exercise while deriving full benefit.

In a preferred embodiment, a device of the present invention weighing ten (10) pounds, when properly employed, has a beneficial effect roughly equivalent to the employment of a conventional thirty-five (35) pound weight heretofore resorted to in the prior art.

It is a still further object of the present invention to provide a method of forming the exercise devices of the present invention.

In accordance with the teachings of the present invention, an exercise device is disclosed that is intended for strengthening a user's targeted muscle. A substantially-spherical relatively thin-walled housing is provided having a diametral axis, and a weight means is disposed within the housing substantially coincident with the diametral axis thereof. The housing has a cut-away portion, and the housing further has an opening formed therein substantially tangentially of the housing and communicating with the cut-away portion thereof. In this manner, the user's hand may be inserted through the opening in the housing and at least partially around the weight means and radially thereof, so that the user's hand is disposed at least partially between the weight means and the outer wall of the housing during use of the device. Accordingly, a forceful grip is not required by the user; and the necessity for employing the user's conjunctive adjoining muscles is substantially reduced, thereby substantially reducing the tendency to detract from the development of the user's targeted muscle.

Preferably, the housing includes a pair of substantially hemispherical housing portions suitably joined together. In a preferred embodiment, a peripheral edge on one of the hemispherical housing portions includes an arcuate rib which mates with a complementary arcuate rib on the other housing portion.

The weight means preferably comprises a cylinder; and each of the housing portions has a circular recess formed therein to receive a respective end of the cylinder, thereby keying and retaining the cylinder between the respective housing portions.

In one embodiment, the cylinder has a pair of open ends; and a cap is received over the respective open ends of the cylinder. The weights may include one or more circular discs and, if desired, one or more "dummy" or "filler" discs may be inserted within the cylinder. Preferably, the weights comprise lead discs, while the "filler" weights comprise foam plastic discs. As a result, a range of weights may be provided using the same general design and components of the present invention.

In another embodiment, the cylindrical weight means comprises a pair of lead discs separated by a cylinder comprising a dowel rod having the same outer diameter ("O.D.") of the lead weights. The lead weights may have a variable thickness and conversely, the dowel rod may have a variable length, thereby providing a range of weights using the same general design and components of the present invention.

In yet another embodiment, the cylindrical weight means, which is retained between the complementary housing portions, comprises a metal cylinder preferably in the form of a sleeve having a constant O.D. and a variable inner diameter ("I.D.") , thereby varying the weights and providing for a range of exercise devices.

Preferably, the outer surface of the housing has a flat surface formed thereon, thereby preventing the device from rolling when the flat surface is placed on a table, bench or the like.

Additionally, a textural surface or padding is disposed within the housing, thereby providing a cushion for the hand of the user which is disposed within the device during the use thereof.

Viewed in another aspect, there is herein illustrated and described a preferred embodiment of the teachings of the present invention, wherein the exercise device has a housing including complementary housing halves, each of which is relatively thin-walled. These housing halves have peripheral edges joined together along a common midplane between the housing halves, and means are provided for securing the housing halves together. Each of the housing halves has a concave recessed portion formed therein; and the concave recessed portions are substantially aligned with one another when the housing halves are joined together. A weight means is disposed within the concave recessed portions substantially at right angles to the common midplane between the housing portions. The housing further has an opening formed therein substantially tangentially of the housing, whereby the hand of the user may be inserted through the opening in the housing and at least partially around the weight means radially thereof. The user's hand is disposed at least partially between the weight means and the wall of the housing, such that a forceful grip is not required by the user, and such that the necessity for employing the user's conjunctive adjoining muscles is substantially reduced, thereby substantially reducing the tendency to detract from the development of the user's targeted muscle.

Preferably, the housing is substantially spherical; the housing halves are substantially semi-spherical; and the weight means is substantially cylindrical. Moreover, the spherical housing has a diametral axis, and the cylindrical weight means is substantially coincident with the diametral axis of the spherical housing.

Viewed in yet another aspect, there is herein illustrated and described an improved method for using an exercise device, wherein a forceful grip on the exercise device is not required, wherein the necessity for employing the user's conjunctive adjoining muscles is substantially reduced, thereby substantially reducing the tendency to detract from the development of the user's targeted muscle; and wherein the exercise device has a beneficial effect on the targeted muscle which is substantially the same as that of a conventional exercise device having approximately 3.5 times the weight of the improved exercise device of the present invention.

Viewed in yet still another aspect, there is herein illustrated and described, an exercise device including a housing having a weight means disposed therein and further having an opening formed therein substantially tangentially of the housing. The opening is bounded by a relatively-thin outer wall and an inner wall having respective convex and concave portions, whereby the hand cf the user may be inserted through the opening in the housing. In this manner, the user's hand is disposed between the inner and outer walls, such that the palm of the user's hand rests substantially on the convex portion of the inner wall, and such that the heel of the user's hand rests substantially on the concave portion of the inner wall. As a result, a forceful grip is not required by the user, and the necessity for employing the user's conjunctive adjoining muscles is substantially reduced, thereby substantially reducing the tendency to detract from the development of the user's targeted muscle.

Generally speaking, the exercise device of the present invention is intended to improve certain targeted muscles of the user extending from, and including, the user's waist or abdominal area. Thus, and while not limited thereto, the targeted muscles may comprise the biceps, triceps, forearm, back, deltoid or shoulder muscles, and the pectoral or chest muscles.

The present invention also constitutes a method for forming an exercise device intended for strengthening a user's targeted bicep muscle and the like. This method includes forming a pair of substantially hemispherical, complementary relatively thin-walled housing portions. Each of the housing portions is formed with a cut-away portion. Each of the housing portions further has an edge including an arcuate rib. Each of the housing portions further has a circular recess formed therein. A cylinder is formed from a single sheet of material; and the cylinder has a pair of opposed ends, at least one of which is open. The cylinder is folded into a substantially flat shape for shipment and unfolded into a substantially cylindrical shape for manufacture of the exercise device. The desired weight or weights are slidably received into the unfolded cylinder. Each opposed end of the cylinder is inserted into a respective circular recess, thereby supporting the cylinder. The arcuate ribs of each edge of the housing portions are keyed to one another, and the housing portions are secured together. In this manner, a substantially spherical housing having a diametral axis and a cut-away portion is formed. The housing further has an opening formed therein which is substantially tangentially of the housing and communicates with the cut-away portion thereof. In this manner, the hand of the user may be inserted into the opening in the housing and at least partially around the cylinder radially thereof. The user's hand is disposed at least partially between the cylinder and the wall of the housing, such that a forceful grip is not required by the user, and such that the necessity for employing the user's conjunctive adjoining muscles is substantially reduced, thereby substantially reducing the tendency to detract from the development of the user's targeted muscle.

Preferably, this method further includes forming a cap for each respective open end of the cylinder, and placing the cap over each respective end of the cylinder (after the desired weight or weights have been received within the cylinder and before each end of the cylinder has been inserted into a respective circular recess) whereby the weights are retained in the cylinder.

These and other objects of the present invention will become apparent from a reading of the following specification, taken in conjunction with the enclosed drawings.

BRIEF DESCRIPTION OF THE DRAWINGS

FIG. 12 is a side elevation of the body portion of the casing for the weight means, wherein the body portion is folded into a substantially flat shape for shipment.

FIG. 13 is an end view of the body portion of FIG. 12.

FIG. 14 is a side elevation of the body portion of the casing, wherein the body portion is unfolded into a substantially cylindrical shape for use thereof during manufacture of the exercise device.

FIG. 15 is an end view of the unfolded cylindrical body portion, corresponding substantially to FIG. 14.

FIG. 16 is a perspective view of the cylindrical body portion with a cap inserted on one end thereof and further with weights being disposed therein.

FIG. 17 is a further perspective view of the cylindrical body portion having all the weights disposed therein, further showing the insertion of a cap on the other end thereof.

FIG. 18 is a perspective view of the cylindrical weight means being disposed in the respective concave inner recess of one of the hemispherical housing portions.

FIG. 19 is another perspective view of the other of the hemispherical housing portions, shown partially disposed over the other of the opposed ends of the cylindrical weight means.

FIG. 20 is still another perspective view, showing the hemispherical housing portions being assembled and almost completely covering the cylindrical weight means.

DESCRIPTION OF PREFERRED EMBODIMENTS

Figure 1:
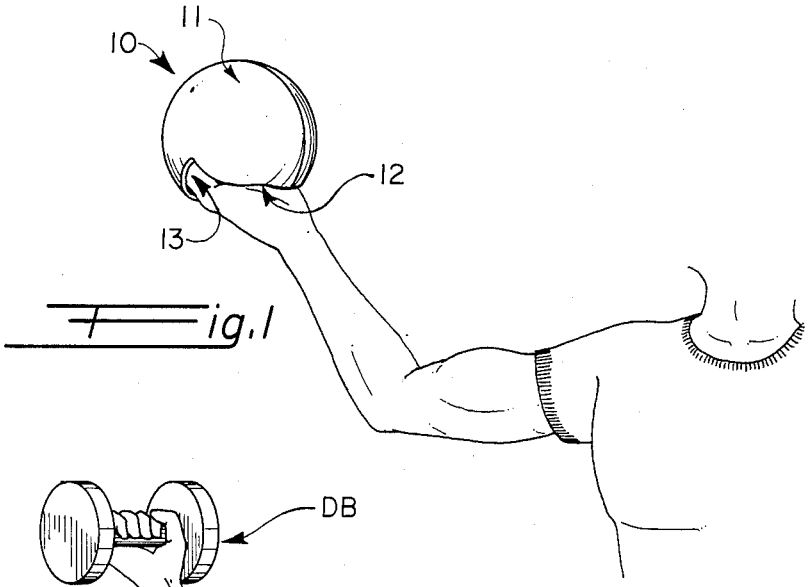
FIG. 1 is a pictorial view of the exercise device of the present invention, illustrating one use of the device for strengthening the user's targeted muscle which, in this case, is the bicep.

With reference to FIG. 1, there is illustrated the exercise device 10 of the present invention for strengthening one of the user's targeted muscles (in this case, the bicep) such that a forceful grip is not required by the user. Such an arrangement substantially eliminates the necessity for employing the user's conjunctive muscles adjoining the bicep. In this manner, the tendency to detract from the development of the user's targeted bicep muscle is substantially reduced.

Figure 1A:
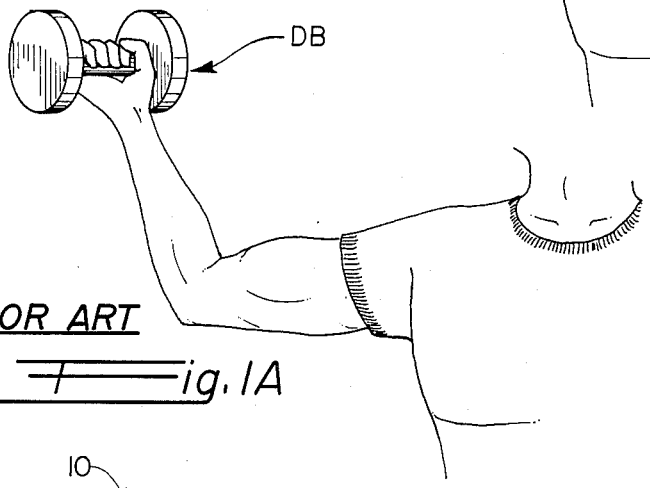
PRIOR ART Fig. 1A
FIG. 1A is a pictorial view of a conventional prior art dumbbell, illustrating its normal use.

By comparison, and with reference to FIG. 1A, there is illustrated the use of a conventional dumbbell DB for strengthening the user's targeted muscle (again, in this case, the bicep). In using these conventional devices, such as a dumbbell, the user must forcefully grip the handle of the dumbbell. This gripping action has the tendency to detract from the development of the user's targeted bicep muscle, thereby substantially reducing the efficiency of the device.

The same concept is equally applicable to other targeted muscles, besides the bicep, consonant with the teachings of the present invention.

Figure 2:
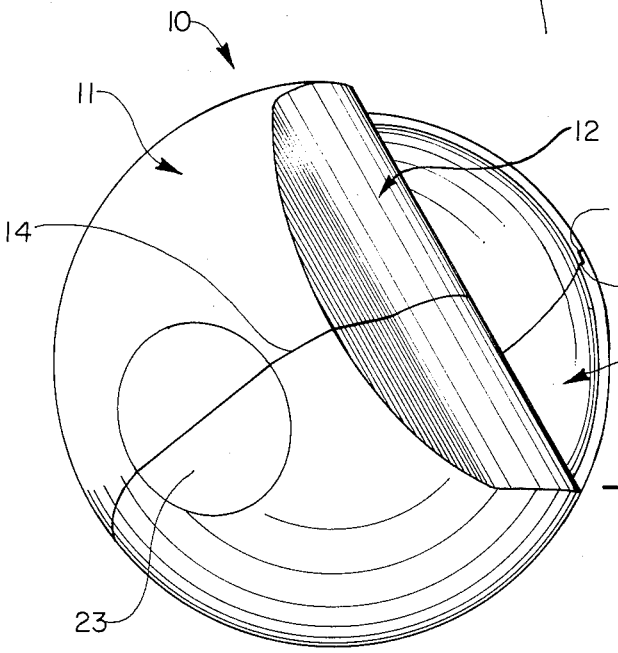
FIG. 2 is a perspective view of a preferred embodiment of the exercise device of the present invention.
Figure 3:
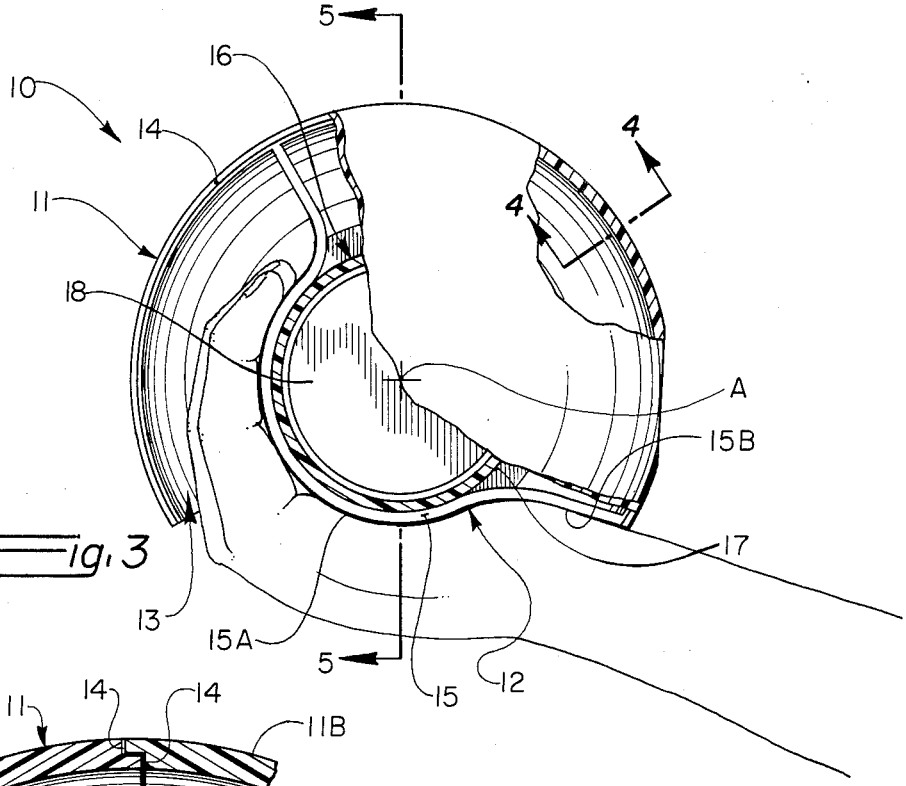
FIG. 3 is a side elevational view of the exercise device, with parts thereof broken away and sectioned, to show the positioning of the user's hand therein between the relatively thin-walled housing and the cylindrical weight means mounted in the housing.
Figure 4:
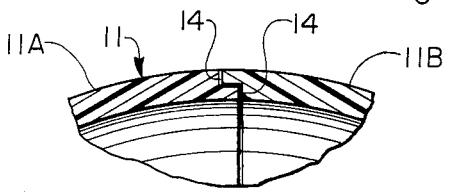
FIG. 4 is a section view, taken along lines 4—4 of FIG. 3 and drawn to an enlarged scale, and showing the arcuate ribs between the complementary relatively thin-walled hemispherical housing portions.
Figure 5:
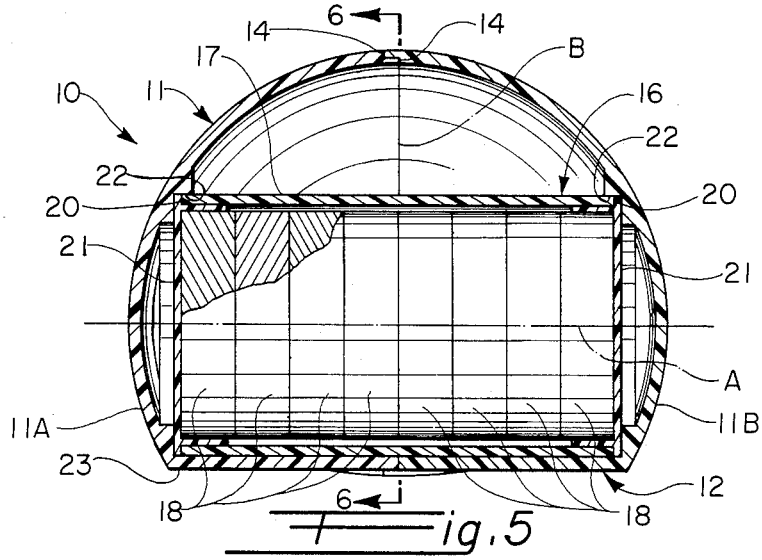
FIG. 5 is a section view, taken along lines 5—5 of FIG. 2, and showing the manner in which the cylindrical weight means is mounted between the complementary housing portions.
Figure 7:
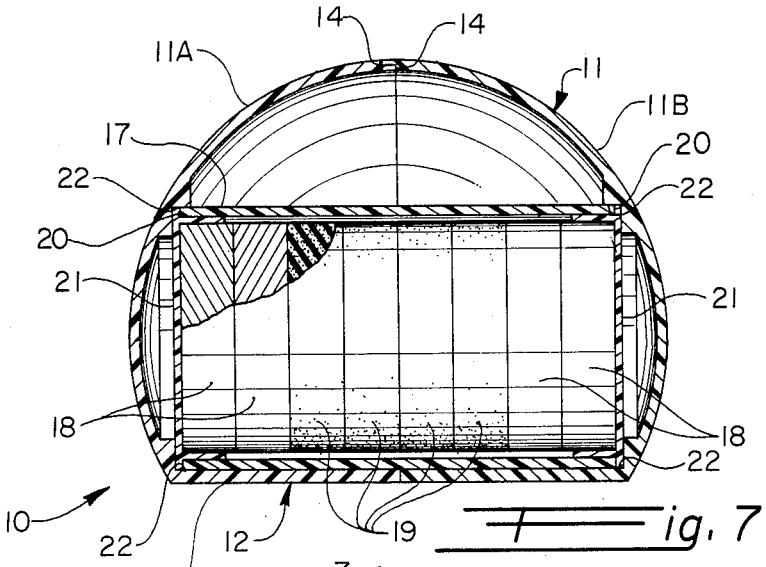
FIG. 7 is another section view, corresponding substantially to FIG. 5, but showing several "filler" or "dummy" weights disposed in the cylinder.
Figure 6:
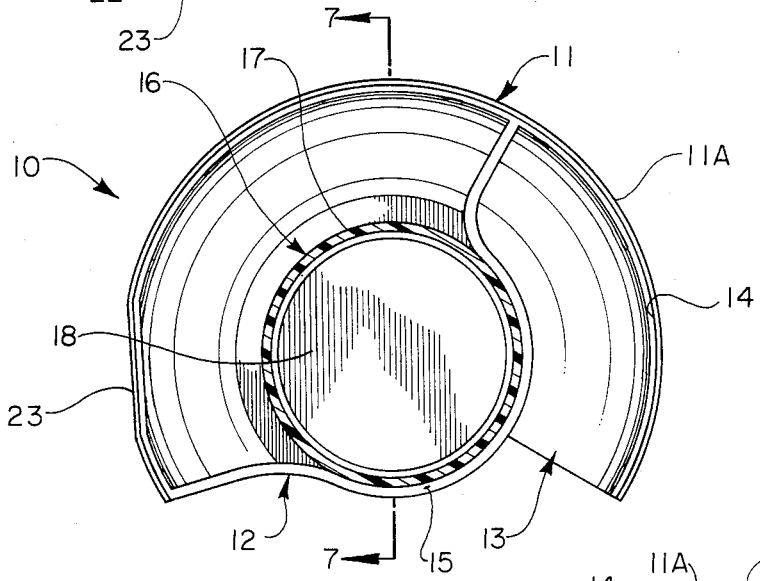
FIG. 6 is a section view, taken along lines 6—6 of FIG. 5.
Figure 8:
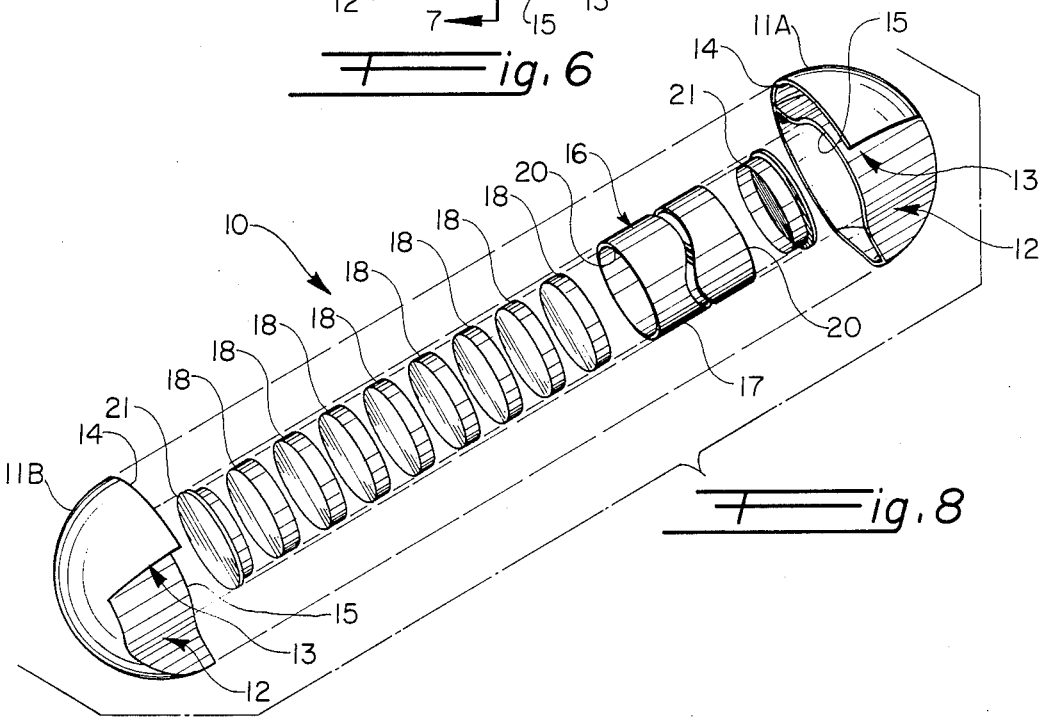
FIG. 8 is an exploded perspective view of the exercise device of FIG. 5.

With reference to FIGS. 2–4, the exercise device 10 includes a substantially-spherical relatively thin-walled housing 11 having a diametral axis designated at A. The housing 11 includes a pair of housing portions 11A and 11B joining at a common midplane B. Each of the housing portions 11A and 11B is preferably substantially hemispherical and identical to one another; moreover, the housing halves 11A and 11B are molded from a suitable plastic material, such as a polycarbonate having relatively high impact strength. However, it will be expressly understood and appreciated by those skilled in the art that the present invention is not so limited.

With this in mind, the housing 11 has a cut-away portion 12 formed therein. The housing further has an opening 13 formed therein substantially tangentially of the housing 11 and communicating with the cut-away portion 12. Through this opening 13, and as shown more clearly in FIG. 3, the hand of the user may be inserted into the housing 11 for use of the exercise device 10.

The housing 11 includes a suitable keying means between the pair of hemispherical portions 11A and 11B, whereby the hemispherical portions are retained together and form the substantially spherical housing 11. Preferably, and as shown more clearly in FIG. 4, this keying means includes an arcuate rib 14 formed on the peripheral edges of each of the housing portions 11A and 11B. These ribs 14 are complementary and are mated when the housing portions 11A and 11B are brought together to form the spherical housing 11. Thereafter, the edges of the housing portions 11A and 11B are glued, ultrasonically welded, or otherwise integrally joined with one another.

Each of the thin-walled housing portions 11A and 11B has a concave inner walled portion 15 forming a circular recess (for purposes hereinafter described).

With further reference to FIGS. 5–8, the weight means comprises a casing 16 disposed within the housing 11 and, preferably, substantially coincident with the diametral axis A of the housing 11 and at right angles to the common midplane B between the housing portions 11A and 11B. The casing 16 has a body portion 17, within which disc-shaped weights 18 and/or "dummy" weights or "fillers" 19 are disposed. Preferably, the casing 16 is substantially cylindrical in shape. However, it is to be understood that any suitable shape of the casing 16 may be employed (and other types of ballast may be employed other than the fillers 19) consonant with the teachings of the present invention. The body portion 17 of the casing 16 further has a pair of opposed ends 20, each of which is preferably open.

A cap 21 is disposed over each open end 20 of the casing 16. The caps 21 aid in retaining the selected weights 18 and/or "fillers" 19 within the casing 16. If desired, the caps 21 may be omitted entirely, with either (or both) opposed end portions 20 being integrally sealed with a respective end wall, or with both ends 20 being left open.

Disposed in the casing 16 is the selected weights 18 and/or "fillers" 19 which are desired to be lifted by the targeted muscle. It is preferred that each weight 18 be shaped substantially coincident with the shape of the interior of the casing 16, and particularly the body portion 17 thereof. If, as in the preferred embodiment, the casing is substantially cylindrical in shape, then each weight 18 and/or "filler" 19, is preferably substantially disc-shaped in appearance and is sized to be received within the body portion 17 of the casing 16. The weights 18 may be fabricated from lead, steel, sand enclosed in plastic, or any other suitable material.

The "dummy" weights or "fillers" 19 may be utilized in place of any one or several of the weights 18. Such "fillers" 19 are preferably fabricated from a foam plastic (or other suitable) material having substantially identical geometric proportions as the weights 18 themselves. By substituting any one or several "fillers" 19 for the "real" weights 18, the weight of the device 10 being lifted by the targeted muscle (the bicep, for example) may vary from substantially zero (wherein all "fillers" 19 and no weights 18 are utilized) to a maximum value (wherein all weights 18 and no "fillers" 19 are utilized).

It is to be understood that any suitable weight or weights may be employed consonant with the teachings of the present invention. In a preferred embodiment, each of the weights 18 weighs 1.25 pounds. If the casing 16 is sized so as to receive eight (8) such 1.25 pound weights 18 therein, then no "fillers" 9 are employed, and basically, a ten (10) pound weight is obtained for the exercise device; and if only four (4) of the weights 18 are employed, then basically, a five (5) pound weight is obtained, in which case four (4) fillers 19 are employed as shown more clearly in FIG. 7. In a preferred embodiment, the complementary hemispherical housing halves 11A and 11B, together, weigh ten ounces (10 oz.) and, if desired, this weight may be taken into account in determining the weight of the overall exercise device 10. Moreover, if desired, a heavier weight may be chosen for the housing halves 11A and 11B.

While it is not necessary that such "fillers" 19 be utilized, the use of such "fillers" 19 aids in filling the interior of the casing 16, thereby preventing the weights 18 disposed therein from shifting during the use thereof. If such "fillers" 19 were not provided, then the weights 18 disposed therein may be subject to lateral movements (or "shifting") within the casing 16 during use of the device 10.

As noted herein, each of the hemispherical housing portions 11A and 11B of the relatively thin-walled housing 11 is provided with a concave inner walled portion 15. Each of these concave inner portions 15 receives and supports a respective opposed end 20 of the casing 16 therein, when the hemispherical housing portions 11A and 11B are joined to one another. Preferably, each of the opposed ends 20 is further supported on a respective internal annular shoulder 22 formed in each of the concave inner portions 15.

With reference again to FIG. 3, during use of the exercise device 10 of the present invention to strengthen the user's bicep (for example), the hand of the user is inserted through the opening 13 in the housing 11 and at least partially around the casing 16 radially thereof. In this manner, the user's hand is "cradled" in the hollow spherical housing 11, being at least partially disposed between the casing 16 and the relatively-thin wall of the housing 11. The palm of the user's hand is supported substantially against the convexly-formed inner walled portion 15A, such that the heel of the user's hand is supported substantially on the concave section 15B of the inner walled portion 15.

When utilized in this fashion, the user's hand at all times remains in a comfortable, natural "at rest" position. In such a manner, a forceful grip by the user is not required throughout the full range of motion of the exercise device 10, such that the necessity for employing the user's muscles which adjoin the bicep (the conjunctive muscles) is substantially reduced. As a result, the device 10 substantially reduces the tendency to detract from the development of the user's targeted muscle (in this case, for example, the bicep).

Figure 9:
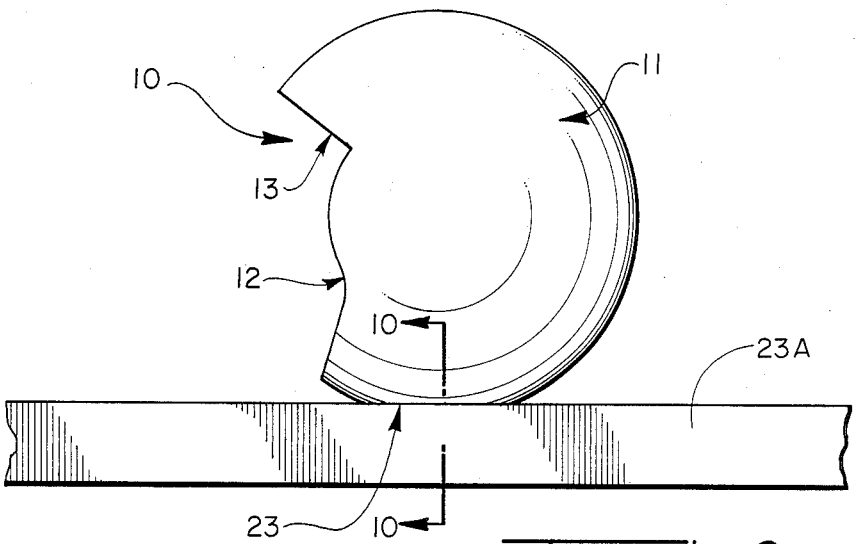
FIG. 9 shows the positioning of the exercise device of the present invention upon a table (or other surface) so that the exercise device will not roll off the table.
Figure 10:
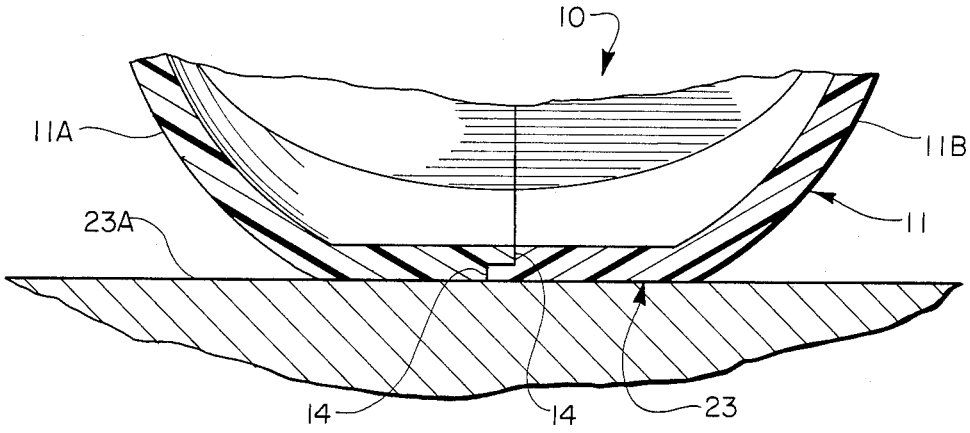
FIG. 10 is a section view thereof, taken along lines 10—10 of FIG. 9, and drawn to an enlarged scale.

With reference to FIGS. 9 and 10, the outer surface of the housing 11 may, if desired, be truncated to form a flat surface 23 thereon. Provision of this flat surface 23 aids in preventing the device from rolling when the exercise device 10 is placed on a substantially flat surface, such as a table 23A as illustrated in FIGS. 9 and 10.

Figure 11:
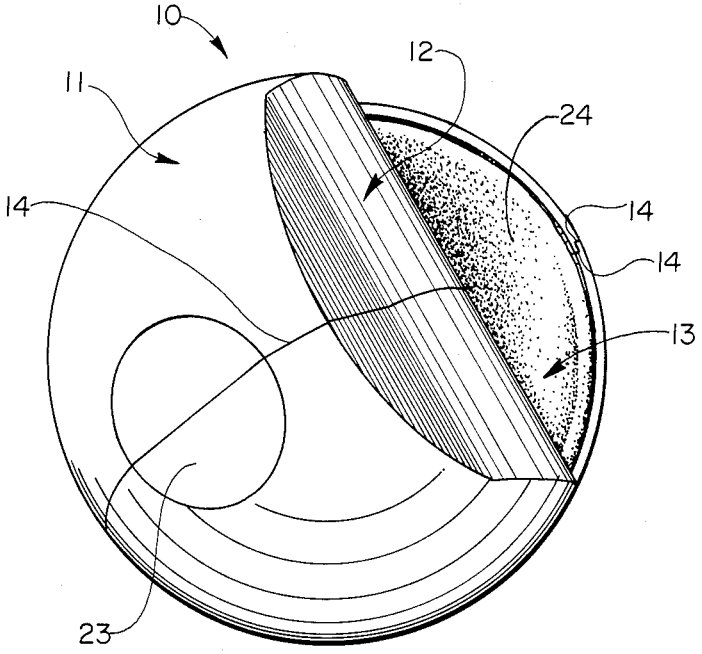
FIG. 11 is another perspective view of the exercise device of the present invention, showing the padding disposed within the housing for providing a cushion for the hand of the user during use of the device.
Figure 12:
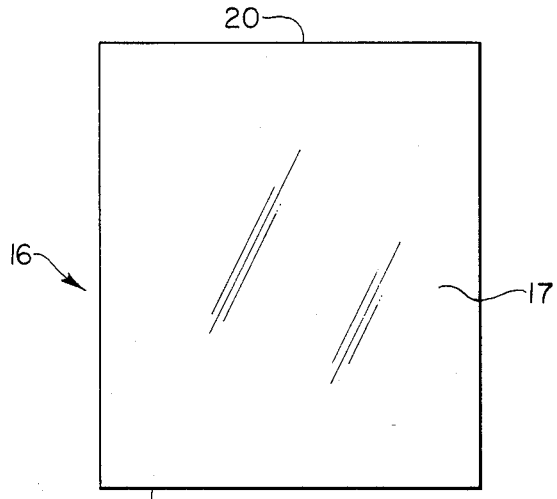
FIGS. 12–20 are sequence views, illustrating the method for forming and assembling a preferred embodiment of the exercise device of the present invention.
Figure 14:
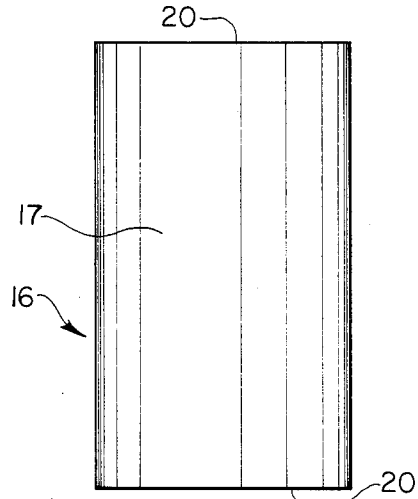
Figure 13:
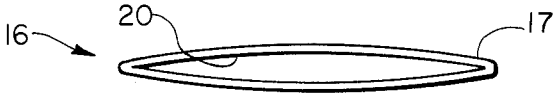
Figure 15:
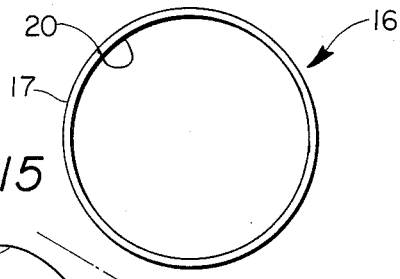

With reference to FIG. 11, in a preferred embodiment of the exercise device 10, a padding 24 (or other suitable means) may be disposed within the housing 11 and between the casing 16 and the housing 11. In this manner, a cushion is provided for the hand of the user which is disposed in the exercise device 10 during use thereof. Additional padding may be disposed within the housing 11, opposite to the padding 24, if desired.

With reference to FIGS. 12–20, there is illustrated the sequence of steps comprising the preferred method for assembling and forming the exercise device 10 of the present invention.

Preferably, each of the hemispherical housing portions 11A and 11B is molded from a relatively high-impact strength polycarbonate or other plastic or suitable material; and, as previously described, the hemispherical housing portions 11A and 11B are formed as mirror images of each other. If desired, the casing 16 may be molded as a sleeve or tubing or else extruded; but in the preferred embodiment, the body portion 17 of the casing 16 comprises a flexible plastic sleeve which is folded flat for shipment (as shown more clearly in FIGS. 12 and 13) and then is unfolded (as shows more clearly in FIGS. 14 and 15) into a substantially cylindrical shape for use in the fabrication and assembly of the overall exercise device 10. The cylindrical body portion 17 is sold under the trademark "JETRAN" by SLM Manufacturing Corp. (of Somerset, N.J.). Caps 21 are formed for each respective open end of the cylindrical body portion 17.

Figure 16:
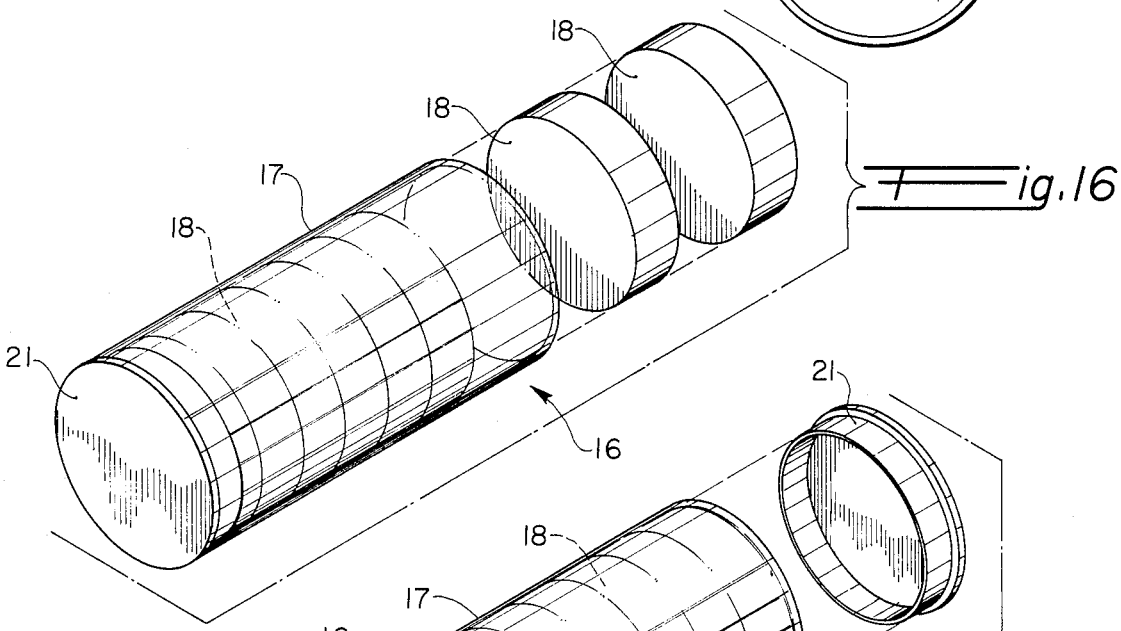
Figure 17:
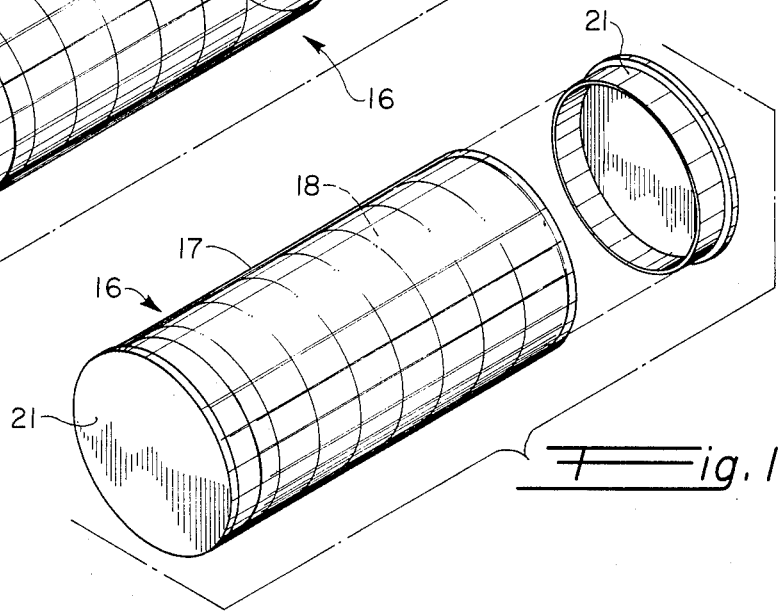

Referring to FIGS. 16 and 17, the cylindrical body portion 17 of the casing 16 has a cap 21 disposed on one of the open opposed ends 20 thereof. The desired weights 18 and/or "fillers" 19 are then received within the cylindrical body 17. The other cap 21 is then disposed on the other of the open opposed end portions 20 of the cylindrical body 17, whereby the weights 18 and/or "fillers" 19 are retained in the cylinder. If desired, these caps 21 may be either removably disposed over each respective end portion 20, whereby the weights 18 and/or "fillers" 19 are removably retained therein, or the caps 21 may be disposed over each respective end portion 20 and integrally secured in place therein, so that the weights 18 and/or "fillers" 19 are permanently retained therein. It is to be noted that the caps 21 may be disposed over each of the end portions 20 in the order described above or a cap 21 may be placed over each respective end portion 20 after the desired weight 18 and/or "fillers" 19 have been disposed in the cylinder 17.

Figure 18:
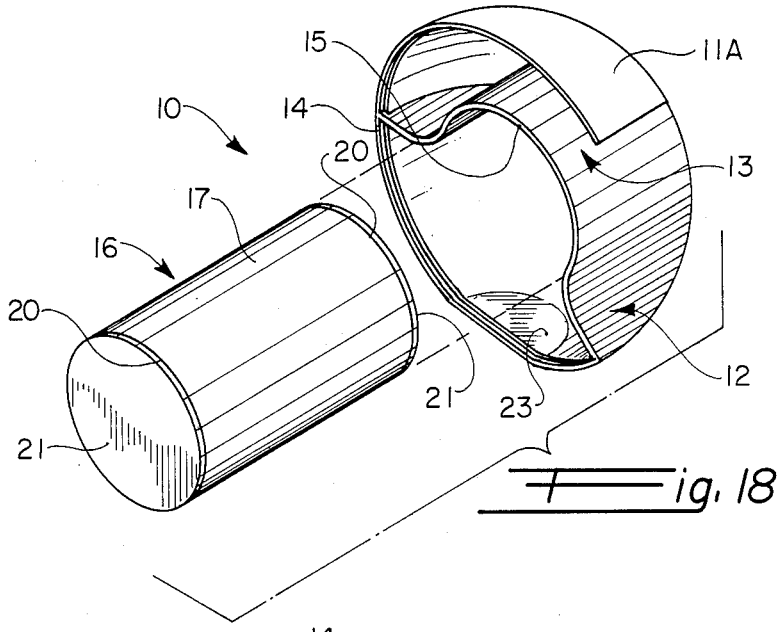
Figure 19:
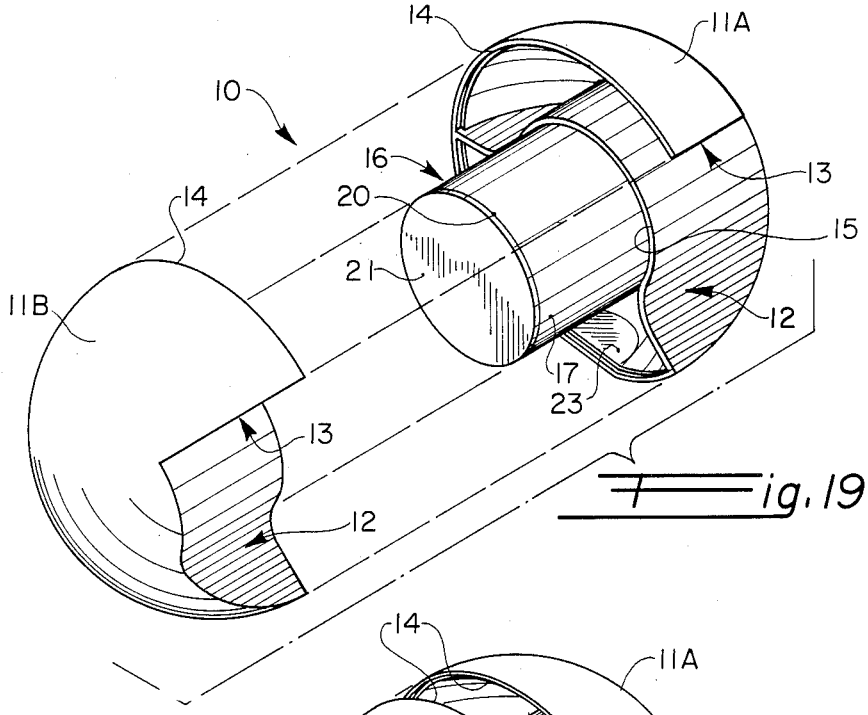
Figure 20:
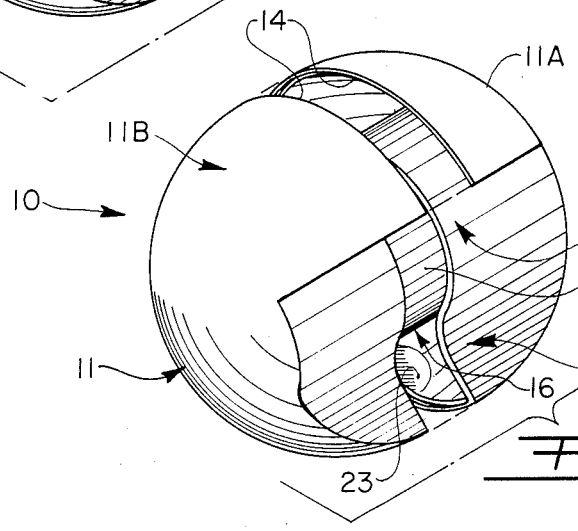

Referring to FIGS. 18–20, the assembled cylindrical casing 16 with the weights 18 and/or fillers 19 therein then has one of the opposed ends 20 inserted into a respective concave inner portion 15 of one of the hemispherical housing portions 11A as shown more clearly in FIG. 18. There, the opposed end 20 is received on and abuts the internal annular shoulder 22, wherein the opposed end 20 of the cylindrical casing 16 is supported. Then the other of the opposed ends 20 is inserted into the other respective concave inner portion 15 of the other hemispherical housing portion 11B (as shown more clearly in FIGS. 19 and 20). There, the other opposed end 20 is received on and abuts the internal annular shoulder 22 therein, wherein the other opposed end 20 of the cylindrical casing 20 is supported.

The respective hemispherical housing portions 11A and 11B are then aligned with one another and brought together, as shown in FIG. 20, such that the arcuate ribbed edges 14 of the hemispherical housing portions 11A and 11B contact one another. The housing portions 11A and 11B are integrally joined together by a suitable adhesive, sonic or ultrasonic welding, or other suitable means. In this manner, a substantially spherical housing 11 having a single diametral axis and a single cut-away portion 12 is formed. The housing 11 further has a single opening 13 formed therein, substantially tangentially of the housing 11 and in communication with the cut-away portion 12 thereof for the hand of the user to be inserted during use, as herein described. If desired, the housing 11 could have a built-in cylindrical casing formed therein to receive the weights 18, etc., in which case a separate cylinder 17 would not be necessary.

Figure 21:
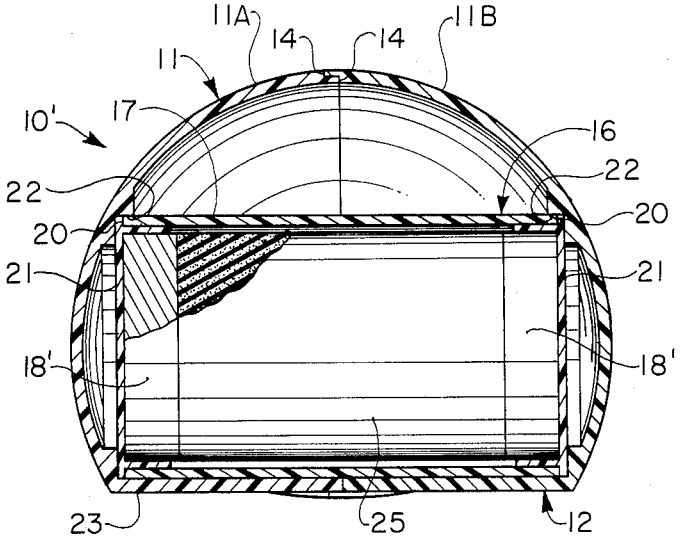
FIG. 21 is a longitudinal section of a second embodiment of the present invention, corresponding substantially to that of FIG. 5, but showing a pair of circular discs separated by a dowel rod to form the cylindrical weight means within the housing.
Figure 22:
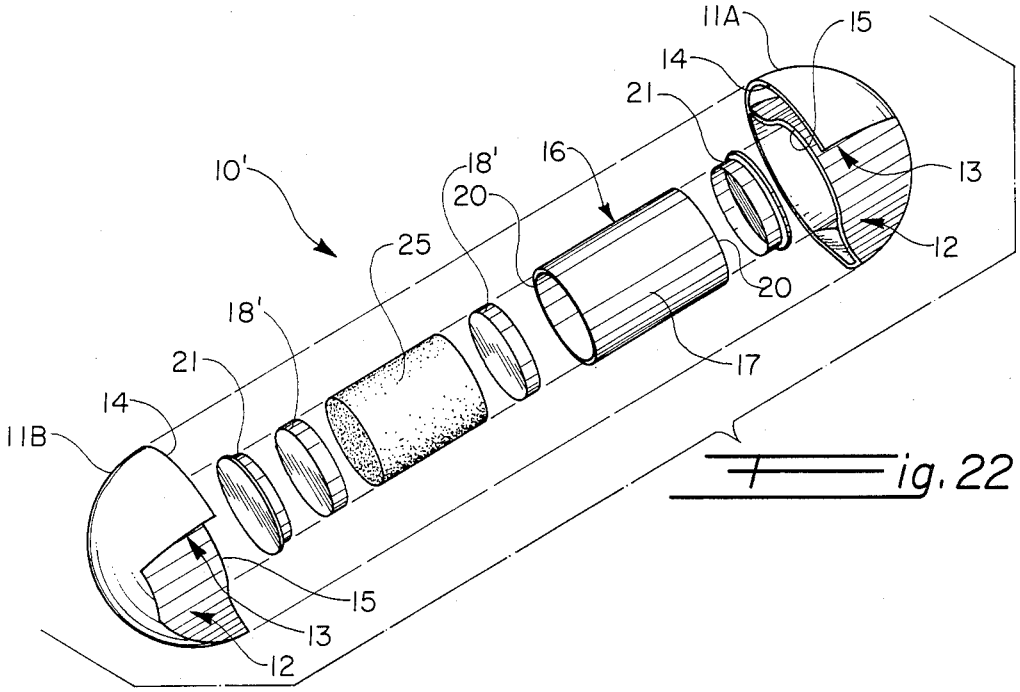
FIG. 22 is an exploded perspective view thereof.

With reference to FIGS. 21 and 22, constituting a first alternate embodiment 10' of the present invention, a pair of disc-shaped weights 18' are separated by a cylindrical "dummy" block or dowel rod 25. The outer diameter ("O.D.") of the weights 18' and the dowel rod 25 remain substantially constant; however, the thickness of the disc-shaped weights 18' (and the length of the cylindrical dowel rod 25) may be changed to provide a heavier (or lighter) weight for the exercise device 10'. This accommodates a range of exercise devices of different weights, thus facilitating an entire product line using the same housing members 11A and 11B. Like the other embodiments of the present invention, this achieves market expansion and penetration consonant with manufacturing standardization.

Figure 23:
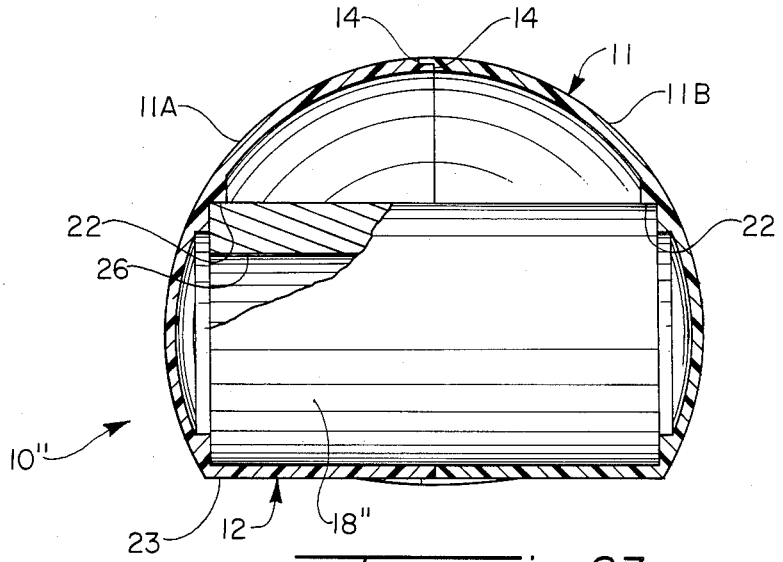
FIG. 23 is a longitudinal section of a third embodiment of the present invention, corresponding substantially to that of FIG. 5, but showing a weighted sleeve to form the cylindrical weight means within the housing.
Figure 24:
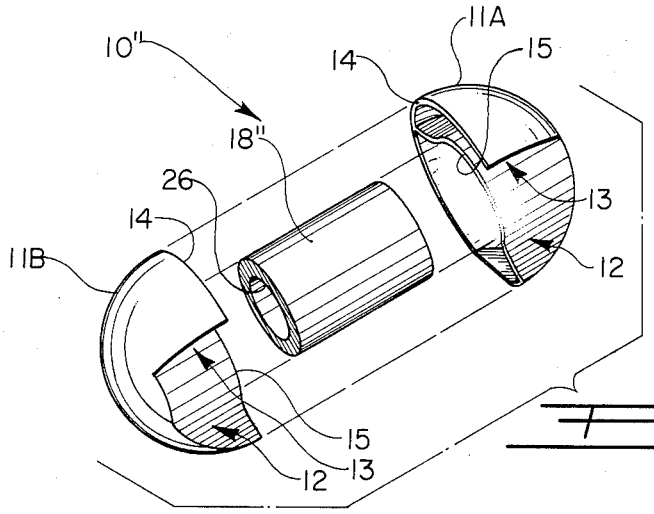
FIG. 24 is an exploded perspective view thereof.

With reference to FIGS. 23 and 24, constituting a second alternate embodiment 10'' of the present invention, a weight 18'' comprising a single cylindrical sleeve is disposed between the respective housing portions 11A and 11B. The cylindrical weight 18'' has a central bore 26 formed therein. Thus, the cylindrical weight 18'' has a substantially constant length; but the bore 26 may have a variable diameter, thereby changing the effective weight thereof for accommodating a desirable product line of exercise devices 10''.

Figure 25:
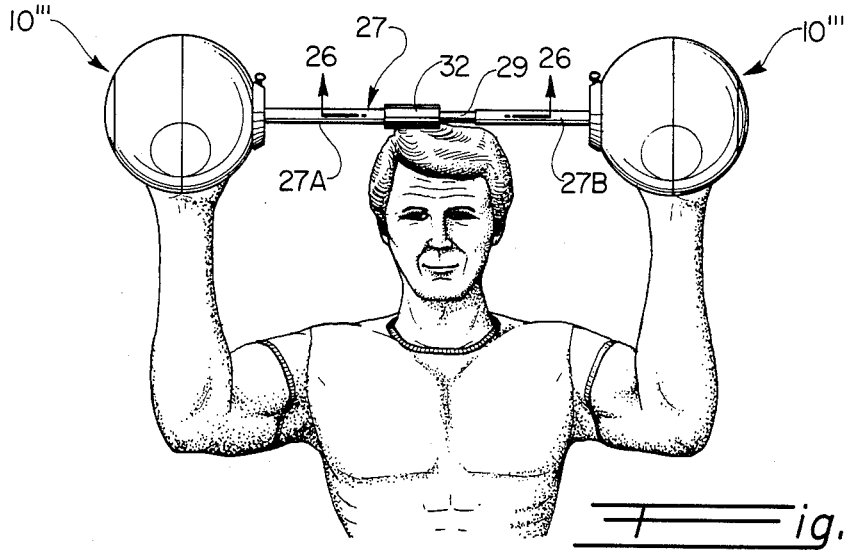
FIG. 25 illustrates how two of the exercise devices of the present invention may be used in combination with a telescoping bar therebetween to form an improved exercise device, the use of which is somewhat similar to that of a conventional barbell.
Figure 26:
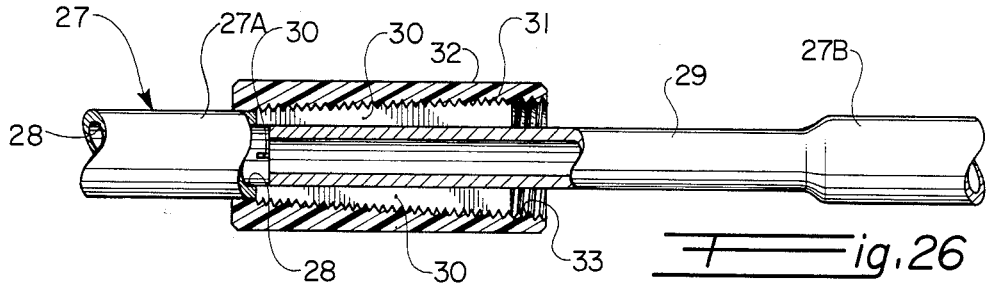
FIG. 26 is a section view (with parts thereof in elevation) taken along the lines 26—26 of FIG. 25, drawn to an enlarged scale, and showing the telescoping members of the bar.
Figure 27:
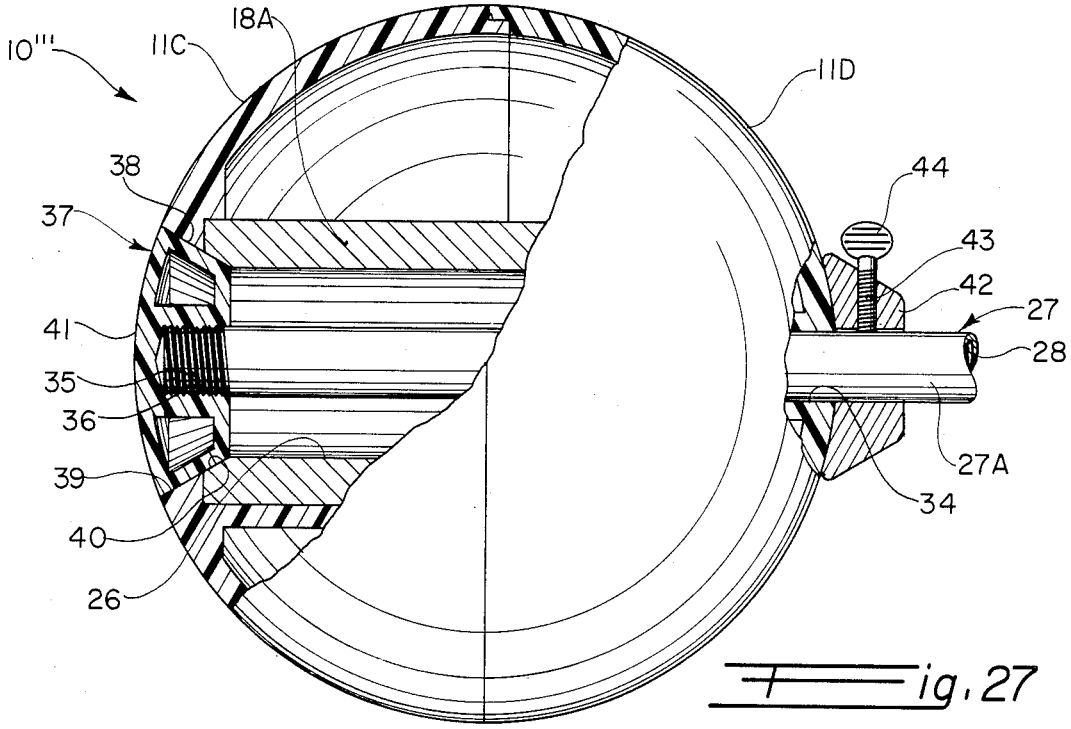
FIG. 27 is a further section view, taken along the lines 27—27 of FIG. 25, drawn to an enlarged scale, and showing the coupling of one of the exercise devices of the present invention to the telescoping bar.

With reference to FIGS. 25–27, a pair of exercise devices of the present invention may be suitably coupled together to form a barbell type of device.

More specifically, an exercise device 10''' is carried on the respective ends of a bar 27. The bar 27 includes telescoping bar members 27A and 27B. Bar member 27A is preferably tubular and has an axial bore 28 to receive a reduced-diameter portion 29 of bar member 27B, as shown more clearly in FIG. 26. Bar member 27A has four circumferentially-spaced slots 30 formed therein, and the outer diameter of bar member 27A is provided with external threads 31 radially of the slots 30. The reduced-diameter portion 29 of bar member 27B is slidably received in the axial bore formed in the tubular bar member 27A to the desired depth to adjust the length of the bar 27 to suit the convenience of the individual user. A clamping collar 32 is slidably carried by the bar member 27A and has an internal taper which is complementary to the external taper on the bar member 27A. The clamping collar 32 has internal threads 33 which engage the external threads 31 on the bar member 27A and exert a radially inwardly-directed pressure on the respective portions of bar member 27A intermediately of the circumferentially-spaced slots 30 formed thereon, thereby securely clamping the bar member 27A to the reduced-diameter portion 29 of the bar member 27B, and thereby retaining the bar 27 in its desired adjusted length. However, it will be appreciated by those skilled in the art that other means for adjusting the length of the bar 27 may be employed consonant with the teachings of the present invention.

With further reference to FIG. 27, the exercise device 10''' includes housing halves 11C and 11D integrally joined together at their peripheral ribbed edges 14, respectively, and exercise device 10''' carries a sleeve weight 18A having a bore 26. Housing half 11D has an opening 34 to receive the bar member 27A, which is telescopically received concentrically within the sleeve weight 18A. The end of bar member 27A is threaded, as at 35, to cooperate with the internally-threaded boss 36 of a clamping disc 37. Clamping disc 37 has a conical or tapered side surface 38 which wedges within a complementary internally-tapered or conical opening 39 formed in housing half 11C. The tapered surface 38 of clamping disc 37 also wedges against an annular chamfered surface 40 formed on the sleeve weight 18A, thereby securely retaining the weight 18A within the housing halves 11C and 11D. The outer surface 41 of clamping disc 37 is formed as a portion of a sphere (as shown more clearly in FIG. 27) so that in the overall assembly, the outer surface 41 of clamping disc 37 forms a smooth continuation of the spherical contours of the exercise device 10''' and, more particularly, its housing half 11C. The bar member 27A also carries a slidable locking collar 42 provided with a set screw 43 having a thumb-actuated portion 44, thereby retaining the exercise device 10''' on the bar member 27A. Bar member 27B has a similar connection with exercise device 10'''. With this arrangement, the exercise devices may be quickly and conveniently removed from the bar 27 and replaced with exercise devices having different weights, as desired, so that the full range of the dual exercise devices is facilitated.

With reference to FIGS. 28–35, the wide-ranging utility and application of the present to the accelerated development of various targeted muscles of the user, besides the bicep illustrated in FIG. 1, will be more readily appreciated. In FIGS. 28–35, the full lines illustrate the natural "at rest" positions, while the broken lines illustrate the stressed positions during use of the exercise device of the present invention. Moreover, it will be appreciated by those skilled in the art that the respective representations of FIGS. 28–35 are illustrative of the present invention and not limiting thereof.

Figure 28:
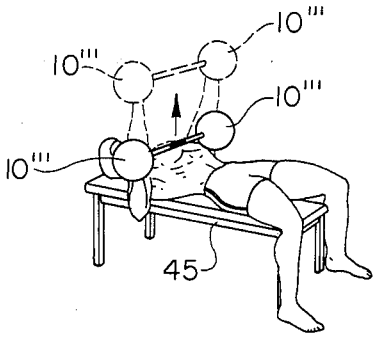
FIGS. 28–35 schematically illustrate various examples for use of the exercise devices of the present invention for the development and improvement of respective targeted muscles.
Figure 29:
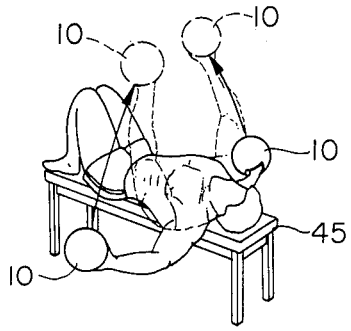
Figure 30:
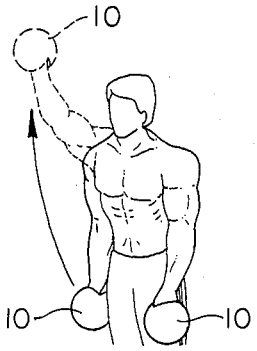
Figure 31:
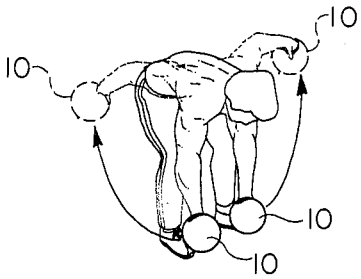
Figure 32:
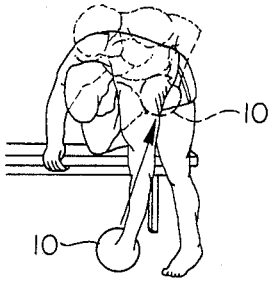
Figure 33:
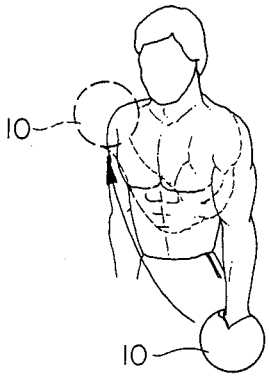
Figure 34:
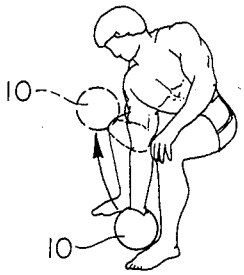
Figure 35:
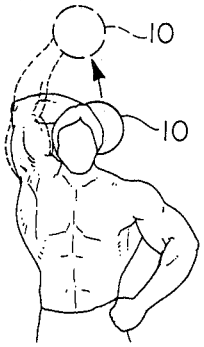

With this in mind, FIG. 28 and 29 illustrate the use of the exercise devices of the present invention for primarily developing and strengthening the chest muscles, as the user lies on a bench 45. FIGS. 30 and 31 illustrate the use of the exercise devices for primarily strengthening the shoulder muscles; FIG. 32 for the back muscles; and FIGS. 33–35 are for the arm muscles. FIG. 30 is a front deltoid raise. FIG. 31 is a bent-over lateral raise; FIG. 32 is a one-arm latissimus row; FIG. 33 is an alternate bicep curl; FIG. 34 is a bicep concentration curl; and FIG. 35 is a tricep extension.

In each case, the user's specific targeted muscle is being developed and strengthened. Since it is not required to exert a firm grip or grasp on the improved exercise devices of the present invention, the use of the adjoining or conjunctive muscles is at least substantially reduced, if not eliminated altogether. Thus, a smaller overall weight may be employed in the exercise devices, yet the beneficial effect will be substantially magnified; and, in a preferred embodiment, the improved exercise devices of the present invention have a beneficial effect which is substantially equal to a conventional weight of approximately 3.5 times the weight of the exercise device of the present invention. Viewed in another aspect, it will be appreciated that with the same exercise time period, the beneficial effect of the exercise devices of the present invention will be substantially enhanced over the use of the conventional devices of the prior art; or, conversely, a substantially reduced exercise time period may be employed to achieve approximately the same beneficial effect normally obtained by using a conventional device over a substantially larger exercise time period.

Moreover, with the same basic design, it is possible to manufacture and market a wide range of exercise devices of various respective weights. Thus, an entire product line has been facilitated for rapid development and market expansion and penetration, yet consonant with manufacturing standardization and relatively low-cost volume production methods.

Obviously, many modifications may be made without departing from the basic spirit of the present invention. For example, the cylindrical casing 16 may be dispensed with (if desired) and complementary cylindrical casings could be integrally molded within the hemispherical housing portions 11A and 11B, such that the desired weights 18 (and/or fillers 19) may be received directly therein. Additionally, the housings for the exercise devices of the present invention may be made of a relatively soft or pliable material, thereby customizing the exercise devices for use by children or handicapped persons going through physical therapy. Indeed, it is even feasible, consonant with the teachings of the present invention, to integrally cast or otherwise suitably form the exercise devices of a substantially solid material (with or without an internal ballast) yet having the same tangential opening and convexo-concave inner wall or surface to accommodate the user's hand without requiring the user to exercise a forceful grip. Accordingly, it will be appreciated by those skilled in the art that within the scope of the appended claims, the invention may be practiced other than has been specifically described therein.

What is claimed is:

1. An exercise device, intended for strengthening a user's targeted muscle, comprising a substantially-spherical, relatively thin-walled housing having a diametral axis, a weight means disposed within the housing substantially coincident with the diametral axis thereof, the housing having a cut-away portion including an inner wall having a concave portion, and the housing further having an opening formed therein substantially tangentially of the housing and communicating with the cut-away portion there of, such that the opening is at least partially bounded by the inner wall, where by the hand of the user may be inserted through the opening in the housing and at least partially around the weight means radially thereof with the heel of the user's hand resting substantially on the concave portion of the inner wall, the user's hand being disposed at least partially between the weight means and the wall of the housing, such that the palm of the user's hand is disposed adjacent to the weight means, such that a forceful grip of the user's hand on the weight means is not required, and such that the necessity for employing the user's conjunctive adjoining muscles is substantially reduced, thereby substantially reducing the tendency to detract from the development of the user's targeted muscle.

2. The exercise device of claim 1, wherein the housing comprises a pair of complementary semi-spherical housing portions, the housing portions having respective peripheral edges formed with complementary arcuate ribs for joining the housing portions together.

3. The exercise device of claim 1, wherein the housing includes an outer surface having a flat surface formed thereon, thereby preventing the exercises device from rolling when the flat surface is placed on a table.

4. The device of claim 1, further including padding disposed within the housing, thereby providing a cushion for the hand of the user disposed therein during use of the exercises device.

5. An exercises device, intended for strengthening a user's targeted muscles, comprising a substantially-spherical, relatively thin-walled housing having diametral axis, a weight means disposed within the housing substantially coincident with the diametral axis thereof, the housing having a cut-away portion, and the housing further having an opening formed therein substantially tangentially of the housing and communicating with the cut-away portion thereof, whereby the hand of the user may be inserted through the opening in the housing and at least partially around the weight means radially thereof, the user's hand being disposed at least partially between the weight means and the wall of the housing, such that a forceful grip is not required by the user, and such that the necessity for employing the user's conjunctive adjoining muscles is substantially reduced, thereby substantially reducing the tendency to detract from the development of the user's target muscle; wherein the housing comprises a pair of complementary semi-spherical housing portions, the housing portions having respective peripheral edges formed with complementary arcuate ribs for joining the housing portions together; and wherein the housing portions have respective concave inner portions, and wherein the weight means is substantially cylindrical and is received within the respective concave inner portions of the housing portions.

6. The exercise device of claim 5, wherein the cylindrical weight means comprises a pair of disc weights having a cylindrical dowel rod disposed therebetween, wherein the disc weights and the dowel row have a substantially constant outer diameter, and wherein the weight of the exercise e vice is determined by the thickness of the disc weights and the length of the dowel rod.

7. The combination of claim 5, wherein the weight means comprises a cylindrical sleeve having a substantially constant outer diameter, the sleeve having a bore providing a variable inner diameter, thereby providing a variable thickness for the sleeve, whereby the weight of the exercise device is determined by the thickness of the sleeve.

8. The exercise device of claim 5, wherein the cylindrical weight means comprises a casing having a cylindrical body received between the concave inner portions, and at least one disc-shaped weight received within the cylindrical body.

9. The exercise device of claim 8, wherein the cylindrical body has a pair of open ends, and wherein a cap is received over each of the open ends of cylindrical body.

10. The exercises device of claim 9, further including an annular shoulder in each of the concave inner portions to receive a respective cap on the cylindrical body.

11. The exercise device of claim 8, further including a plurality of disc weights received within the cylindrical body.

12. The exercise device of claim 11, further including a plurality of "filler" discs within the cylindrical body, wherein the weight of the exercise device is determined by the number of disc weight and filler discs disposed in the cylindrical body.

13. An exercise device, intended for strengthening a user's targeted muscle, comprising a substantially-spherical relatively thin-walled housing having a diametral axis, a substantially cylindrical weight means disposed within the housing substantially coincident with the diametral axis thereof, the housing having a cut-away portion, the housing further having an opening formed therein substantially tangentially of the housing and communicating with the cut-away portion thereof, whereby the hand of the user may be inserted through the opening in the housing and at least partially around the casing radially thereof, the user's hand being disposed at least partially between the casing and the wall of the housing, such that a forceful grip is not required by the user, and such that the necessity for employing the user's conjunctive adjoining muscles is substantially reduced, thereby substantially reducing the tendency to detract from the development of the user's targeted muscle; wherein the housing comprises a pair of substantially hemispherical housing portions, each of said hemispherical housing portions having an edge including an arcuate rib which mates with and is joined to the complementary arcuate rib of the other housing portion, thereby forming the substantially-spherical housing; each of the housing portions having a concave inner portion, wherein the cylindrical weight means has respective ends received and supported in a respective concave inner portion, when the housing portions are joined to one another; the housing further including an outer surface having a flat surface formed thereon, thereby preventing the exercise device from rolling when the flat surface is placed on a table or other flat surface; and padding means disposed within the housing, thereby providing a cushion for the hand of the user disposed therein during use of the exercise device.

14. In an exercise device, the combination of a housing including complementary housing halves, each of which is relatively thin-walled, the housing halves having peripheral edges mated together along a common midplane between the housing halves, means for securing the housing halves together, each of the housing halves having a concave recessed portion formed therein, the concave recessed portions being substantially aligned with one another when the housing halves are joined together, a weight means disposed within the concave recessed portions substantially at right angles to the common midplane between the housing portions, the housing having an opening formed therein substantially tangentially of the housing, whereby the hand of the user may be inserted through the opening in the housing and at least partially around the weight means radially thereof, the user's hand being disposed at least partially between the weight means and the wall of the housing, such that a forceful grip is not required by the user, and such that the necessity for employing the user's conjunctive adjoining muscles is substantially reduced, thereby substantially reducing the tendency to detract from the development of the user's targeted muscle.

15. The exercise device of claim 14, wherein the housing is substantially spherical, wherein the housing portions are substantially semi-spherical, and wherein the weight means is substantially cylindrical.

16. The exercise device of claim 15, wherein the spherical housing has a diametral axis, and wherein the cylindrical weight means is substantially coincident with the diametral axis of the spherical housing and is disposed at right angles to the common midplane between the semi-spherical housing portions.

17. An exercise device comprising a housing having a weight means disposed therein, the housing further having an opening formed therein substantially tangentially of the housing, the opening being bounded by a relatively-thin outer wall and an inner wall having respective convex and concave portions, whereby the hand of the user may be inserted through the opening in the housing, such that the user's hand is disposed between the inner and outer walls, such that the palm of the user's hand rests substantially on the convex portion of the inner wall, and such that the heel of the user's hand rests substantially on the concave portion of the inner wall, whereby a forceful grip is not required by the user, and whereby the necessity for employing the user's conjunctive adjoining muscles is substantially reduced, thereby substantially reducing the tendency to detract from the development of the user's targeted muscle.

18. The exercise device of claim 17, wherein the housing is substantially spherical and has a diametral axis.

19. The exercise device of claim 18, wherein the weight means is substantially cylindrical and is disposed along the diametral axis.

20. The exercise device of claim 17, wherein the housing is substantially solid.

* * * * *